United States Patent [19]

Mizutani et al.

[11] Patent Number: 4,598,993

[45] Date of Patent: Jul. 8, 1986

[54] PROCESS UNIT AND IMAGE FORMATION APPARATUS PROVIDED WITH THE PROCESS UNIT

[75] Inventors: Morikazu Mizutani, Tokyo; Shigeyoshi Onoda, Yokohama; Akihiro Nomura, Kawasaki; Shinji Kanemitsu, Ichikawa; Mototada Toriumi, Yokohama, all of Japan

[73] Assignee: Canon Kabushiki Kaisha, Tokyo, Japan

[21] Appl. No.: 726,186

[22] Filed: Apr. 23, 1985

Related U.S. Application Data

[63] Continuation of Ser. No. 449,501, Dec. 13, 1982, abandoned.

[30] Foreign Application Priority Data

Dec. 22, 1981 [JP] Japan ..... 56-208488

[51] Int. Cl.[4] ..... G03G 15/00

[52] U.S. Cl. ..... 355/3 R; 355/3 DR; 355/133

[58] Field of Search ..... 355/3 R, 3 DD, 3 DR, 355/15, 133

[56] References Cited

U.S. PATENT DOCUMENTS

| | | | |
|---|---|---|---|
| 3,667,840 | 6/1972 | Engel et al. | 355/15 X |
| 4,116,556 | 9/1978 | Tanaka et al. | 355/3 SH |
| 4,327,992 | 5/1982 | Babicz | 355/3 R |
| 4,462,677 | 7/1984 | Onada | 355/3 DR |

*Primary Examiner*—R. L. Moses

*Attorney, Agent, or Firm*—Fitzpatrick, Cella, Harper & Scinto

[57] ABSTRACT

This specification discloses a process unit and an image formation apparatus provided with the process unit. The process unit is detachable with respect to the body of the image formation apparatus, and is characterized by process means acting on an image bearing member, and a guide member in the form of a grip provided at a position capable of maintaining the process unit in substantially horizontal condition, along the direction in which the process unit is mounted or dismounted with respect to the apparatus body, the guide member also performing the function of a grip during transportation of the process unit. The image formation apparatus is characterized by the process unit and support means for detachably supporting the guide member of the process unit.

10 Claims, 10 Drawing Figures

PROCESS UNIT AND IMAGE FORMATION APPARATUS PROVIDED WITH THE PROCESS UNIT

This application is a continuation of application Ser. No. 449,501 filed Dec. 13, 1982, now abandoned.

BACKGROUND OF THE INVENTION

1. Field of the Invention

This invention relates to a process unit and an image formation apparatus provided with the process unit. The term image formation apparatus is intended to include, for example, an electrophotographic copying apparatus, a magnetic recording apparatus or an apparatus such as a micro apparatus for forming on a recording medium an image corresponding to information.

2. Description of the Prior Art

When a copying apparatus using the electrophotographic method is used for a long period of time, replacement of the photosensitive member, supply or replacement of the developer, cleaning of the charging wire and/or other adjustment or replacement becomes necessary and such maintenance works have heretofore been carried out by professional service men. Recently, however, as shown in U.S. Pat. No. 3,985,436, there has been proposed a technique for carrying out such maintenance works without relying on any professional service man to make the copying apparatus operate always in good condition. As an example of such technique, there is a method of making the various constituent members such as the charger, developing device, photosensitive drum, etc. contained in the apparatus into a unit and replacing such unit with a new one. If the apparatus is designed to permit replacement of such unit, it will also become possible to use the same apparatus body multifunctionally by preparing a plurality of such units in accordance with usages and inserting into the apparatus body a unit matching a desired usage.

However, by the user who has a copying apparatus so handling the unit, the maintenance becomes easy and the usages become wider while, on the other hand, problems may arise in the handling of the unit.

It is desirable that the unit can be maintained in a horizontal condition (a condition in which the unit has been loaded into the copying apparatus body) when it is carried or preserved after it is removed from the copying apparatus body. Because the toner storing portion is within the unit, if the unit is carried in its inclined condition or the unit is left vertically standing on a desk or on the floor, the developer may sometimes incline toward one direction. This may result in the undesirable possibility that development becomes partly impossible due to such inclination of the developer. In this case, even if the apparatus has a developer stirring member, much time will be required until the developer is made uniform and thus, the use of the copying apparatus will be limited.

SUMMARY OF THE INVENTION

It is an object of the present invention to prevent any inclination of the developer which may result from the handling of the process unit and to ensure the use of the process unit in its stable condition.

It is another object of the present invention to endow a guide member used to mount or dismount the unit with respect to the copying apparatus body with the function of a grip usable to carry the unit and thereby to make the unit compact.

The invention will become fully apparent from the following detailed description thereof taken in conjunction with the accompanying drawings.

DESCRIPTION OF THE PREFERRED EMBODIMENTS

Description will first be made of an embodiment of the copying apparatus to which the present invention is applicable.

Figure 1:
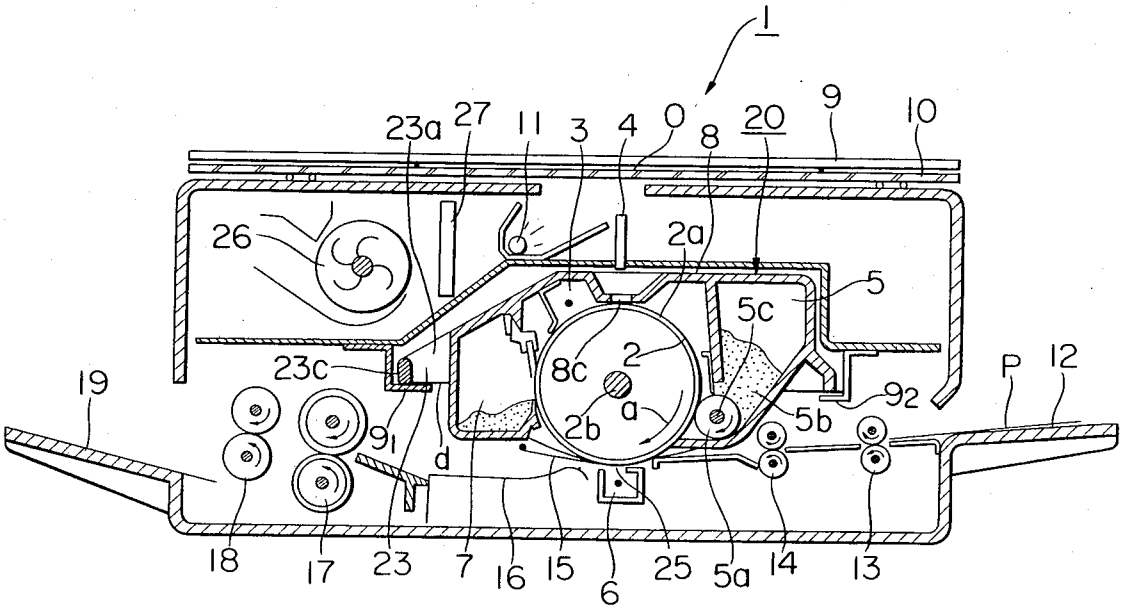
FIG. 1 is a cross-sectional view of a copying apparatus to which the present invention is applied.

FIG. 1 is a cross-sectional view of the essential portions of an electrophotographic copying apparatus to which an embodiment of the present invention is applied.

In FIG. 1, reference numeral 1 designates a copying apparatus using the electrophotographic method. A photosensitive drum 2 comprising a photoconductive layer 2*a* provided on a conductive drum substrate is supported for rotation in the direction of arrow a by a shaft 2*b*. A corona discharger 3, a short focus optical element array 4, a developing device 5, an image transfer corona discharger 6 and a cleaning device 7 are disposed around the drum 2 successively in the direction of rotation thereof. The developing device 5 has a magnet roller 5*a* rotatably supported on a shaft 5*c* provided in parallel with the shaft 2*b*, and a toner reservoir 5*b* for storing toner T therein provided in opposed relationship with the roller 5*a*. In the developing device 5, the developing means 5*a* and the toner reservoir 5*b* may be separate from each other. In this apparatus 1, the photosensitive drum 2, the discharger 3, the developing device 5 and the cleaning device 7 are integrally supported by a housing 8 to form a process unit 20. The housing 8 is guided and supported by guide rails $9_1$ and $9_2$ secured to the apparatus body 1 and may be mounted or dismounted with respect to the apparatus body in a horizontal direction relative to the drum shaft 2*b*.

In the copying apparatus 1, the surface of the photosensitive drum 2 is uniformly charged to a predetermined polarity by the corona discharger 3. An original 0 placed on a reciprocally movable original carriage 10 on top of the apparatus body is then illuminated by a lamp 11 and the reflected light therefrom is projected upon the drum 2 through the element array 4, whereby a latent image is formed on the surface of the drum 2. The latent image thus formed is developed by the developing device 5 by the use of toner T supplied from the toner reservoir 5*b* to the magnet roller 5*a*. The developed image is transferred to a transfer medium by the image transfer corona discharger 6. On the other hand, copy paper P as the transfer medium is supplied onto a transfer medium supply tray 12 by the operator's manual operation and conveyed to an image transfer station 25 at which the image transfer corona discharger 6 is provided, through conveyor rollers 13 and timing rollers 14. The transfer medium P to which the developed image on the drum 2 has been transferred is separated from the surface of the drum 2 by separating means 15. The copy paper P is transported through a movement path 16 to a fixing device 17, whereby the developed image on the copy paper P is fixed, whereafter the copy paper P is discharged onto a paper discharge tray 19 through discharge rollers 18.

Designated by 8*c* is a slit formed in the housing 8 for passing therethrough the original light image directed onto the drum 2 through the array 4. Denoted by 9 is an original cover for pressing the original 0 against the original carriage 10. Reference numeral 26 designates a fan for discharging the air in the apparatus 1, and reference numeral 27 denotes a filter.

Figure 2:
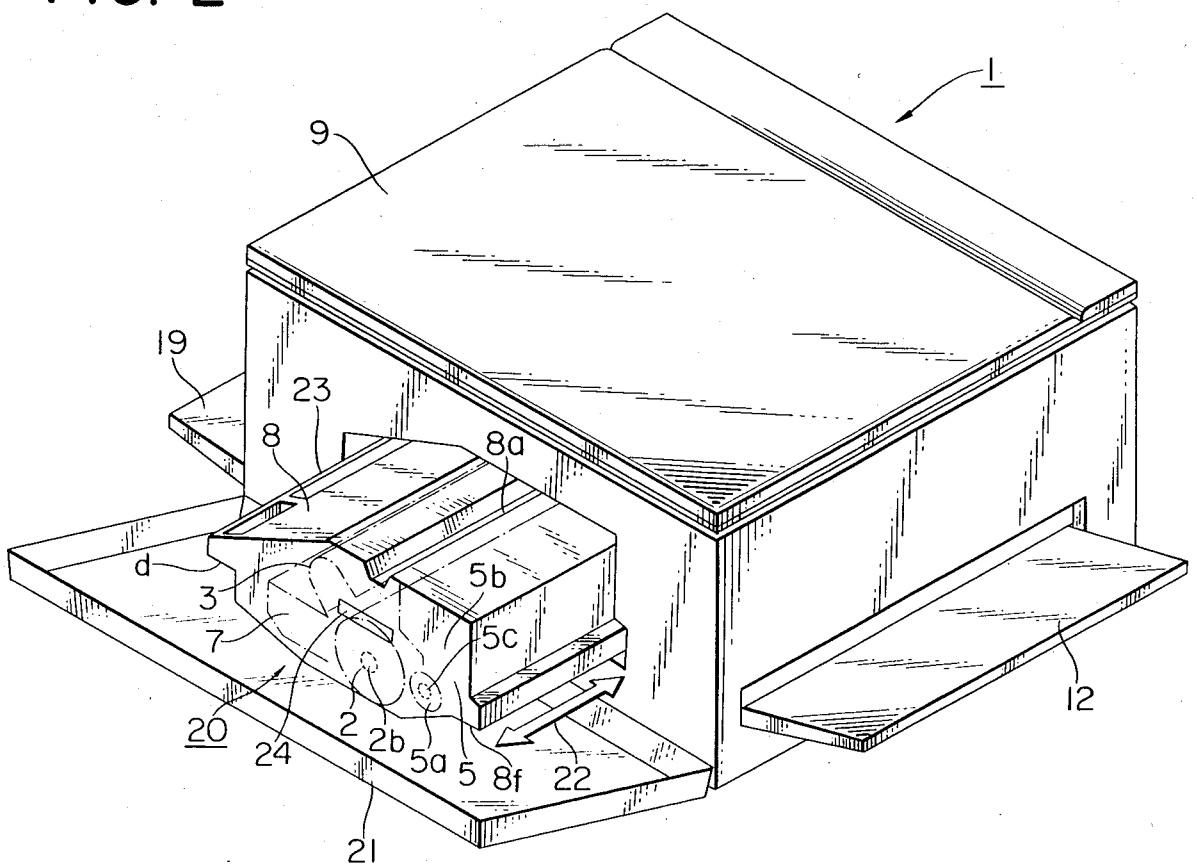
FIG. 2 is a perspective view of the copying apparatus showing an example of the mounting or dismounting of a process unit with respect to the apparatus body.

FIG. 2 is a perspective view showing the mounting-dismounting relation between the apparatus body 1 and the process unit 20. The mounting of the process unit 20 containing the photosensitive drum 2 therein is accomplished by opening the front door 21 of the apparatus body 1, releasing the locking means (not shown) of the unit 20 relative to the apparatus body 1, grasping a grip 24 and withdrawing the housing 8 along the rails $9_1$ and $9_2$. The arrow 22 in FIG. 2 indicates the direction of movement of the housing 8 resulting from the mounting and dismounting of the process unit 20. The grip 24 is provided perpendicularly to the drum shaft 2*b*.

Figure 3:
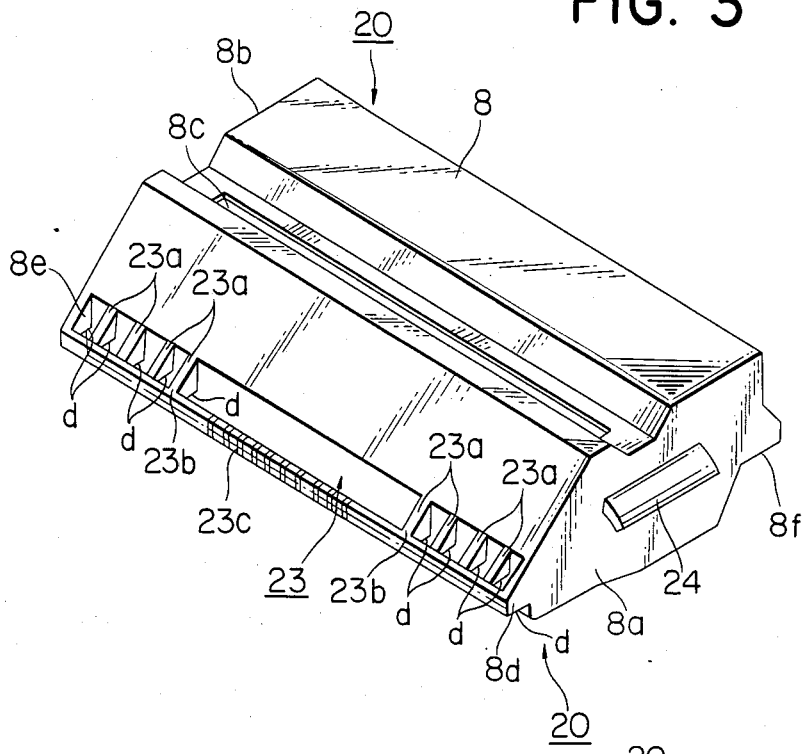
FIG. 3 is a perspective view of the process unit.
Figure 4:
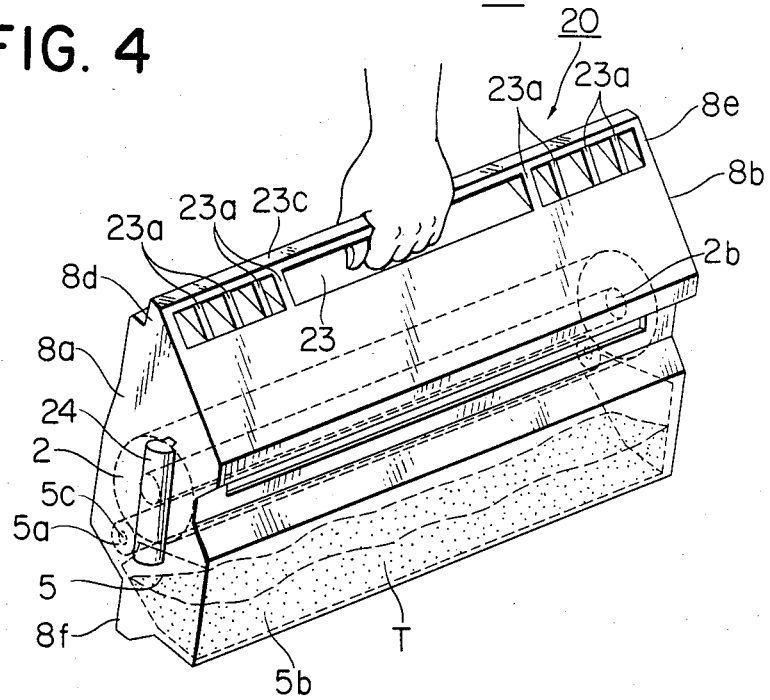
FIG. 4 is a perspective view of the process unit as it is carried.

FIG. 3 is a perspective view of the process unit 20 as seen from the grip 23 side. The grip 23 of the present embodiment is formed integrally with the housing 8 of the process unit 20 on the opposite side from the developing device 5 with respect to the drum 2. That is, the grip 23 is constituted by a bar-like member 23*c* being secured to the ends of convex portions 23*a* projected from the housing 8 and the ends of the outwardly extending portions 8*d* and 8*e* of the side plates 8*a* and 8*b* of the housing 8 integrally with the convex portions 23*a* and the outwardly extending portions 8*d*, 8*e* and in parallel with the drum shaft 2*b* and the magnet roller shaft 5*c*. Thus, the grip 23 is provided substantially in the central portion of the unit 20 in parallel with the lengthwise direction which is the direction of the developing device 5, the cleaning device 7 and the rotary shaft 2*b* of the photosensitive drum 2. Consequently, the process unit 20 can be carried with the toner storing portion 5*b* remaining in its horizontal condition by grasping the grip 23 and, when the process unit is being carried, one of the lengthwise portions thereof is never inclined downwardly and thus, there is no possibility of the toner inclining toward one end of the unit 20 during the carrying of the unit. (FIG. 4 shows the condition in which the unit 20 is being carried.)

Further, in the present embodiment, the above-mentioned outwardly extending portions 8*d* and 8*e* and the lower ends d of the convex portions 23*a* extend perpendicularly to the drum shaft 2*b*. Therefore, the unit 20 can be mounted or dismounted with respect to the apparatus body 1 by causing the outwardly extending portions 8*d*, 8*e*, the lower ends d of the convex portions 23*a* and the lower end of the bar-like member 23*c* to slide along the rail $9_1$ of the apparatus body 1. The other end of the unit 20 slides when the sliding portion 8*f* is mounted or dismounted along the rail $9_2$. That is, according to the present embodiment, the bar-like member 23*c*, the outwardly extending portions 8*d*, 8*e* and the lower ends d of the convex portions 23*a* provide a guide member when the unit 20 is mounted or dismounted with respect to the apparatus body. Moreover, this guide member has a grip shape which can be grasped by the operator and therefore, the guide member can also perform the function of a grip during the carrying of the unit. This eliminates the necessity of separately providing one of the grip for carrying of the unit and the grip for mounting of the unit and thus, can make the unit more compact.

Although the present embodiment has been shown as an example in which the grip serves both the guide function and the grip function, the present invention is not restricted thereto but the guide member and the grip may of course be provided separately from each other. The position at which the grip is installed is neither restricted to the position shown in the present embodiment, but if the grip is only provided on the unit, it may be installed at any position, or a plurality of grips may be provided and need not always be integral with the unit. (These examples are shown in FIGS. 5A–5F). Also, in the present embodiment, the grip has been shown as being provided at the lengthwisely central portion of the unit, whereas the present invention is not restricted thereto but, of course, the grip need not be provided at the central portion if the toner storing portion can be maintained in its horizontal condition. For example, where the center of gravity of the unit is deviated from the central portion thereof, the grip may also be provided at a position deviated from the central portion. Also, a plurality of grips may be provided. As regards the developing device, the developing means for effecting development by the use of toner and the toner reservoir may be integral with each other as in the present embodiment or may be separate from each other.

In the present invention, the image bearing member is not restricted to an organic semiconductor photosensitive layer or a zinc oxide photosensitive layer or the like, but it is apparent that other photosensitive layers may also be used. Further, in the present invention, the image bearing member is not restricted to one using a photosensitive layer, but it is clear that, for example, an image bearing member using an insulating layer or the like may also be used. The shape of the image bearing member is not restricted to the drum shape, but may be, for example, an endless belt passed over pulleys.

In the present invention, the developing means is not restricted to the magnetic brush development shown in the embodiment, but use may be made of developing means such as, for example, cascade development, fur brush development or powder cloud development.

The cleaning system is not restricted to the blade cleaning, but use may be made fur brush cleaning, roller cleaning or web cleaning.

Further, the imaging element is not restricted to the short-focus small-diameter imaging element array, but may also be, for example, an ordinary lens or a bar lens.

The process for image formation is restricted in no way, but may also be, for example, the Carlson system, the NP system (U.S. Pat. No, 3,666,363) or the PIP system.

Figure 5A:
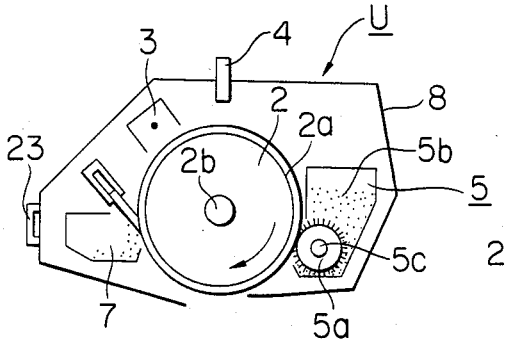
FIGS. 5A–5F are side views of further embodiments of the process unit.
Figure 5B:
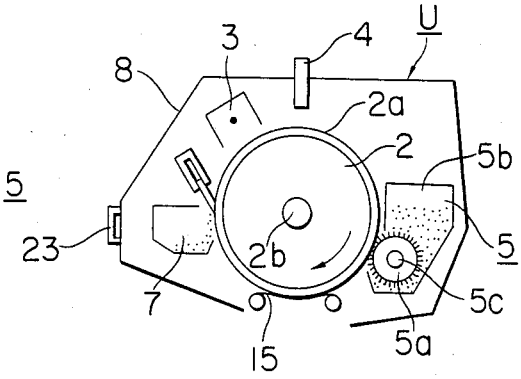
Figure 5C:
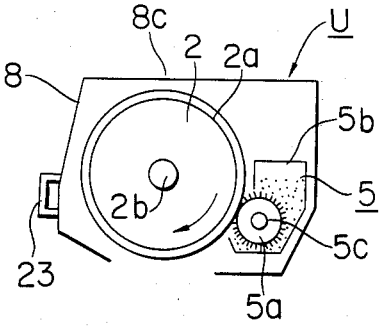
Figure 5D:
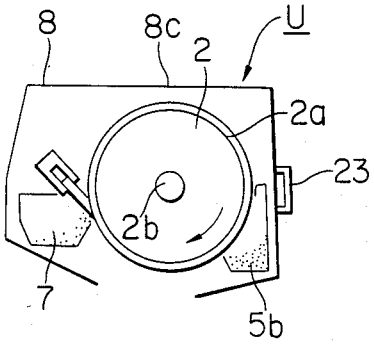
Figure 5E:
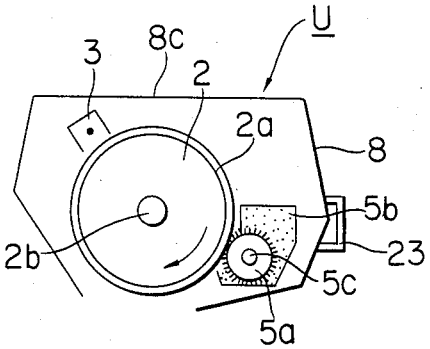
Figure 5F:
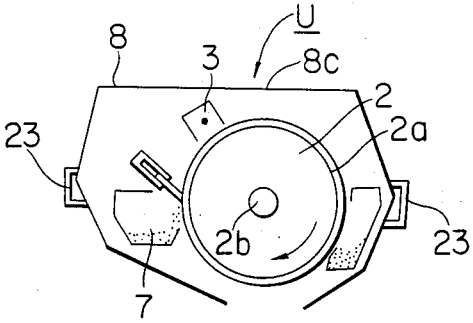

Also, in the present embodiment, an example in which a developing device, a cleaner, chargers, etc. are integrally incorporated as the process means acting on the image bearing member has been shown as the process unit, whereas the present invention is not restricted thereto. For example, the array 2, charger 4, developing device 5 and cleaner 13 as the process means may be integrally incorporated into the unit U with the photosensitive drum 3 (FIG. 5A). Further, the separating means 9*a* may be integrally incorporated (FIG. 5B). Also, the developing device 5 and photosensitive drum 3 (FIG. 5C), or the cleaner 13, photosensitive drum 3 and toner reservoir (FIG. 5D), or the charger 4, developing device 5 and photosensitive drum 3 (FIG. 5E), or the charger 4, cleaner 13, photosensitive drum 3 and toner reservoir (FIG. 5F) may be integrally incorporated. The image bearing member is not restricted to the photosensitive drum 3, as already described. The process unit U need not have the image bearing member, but may have part or the whole of the process means integrally. In the present embodiment, the process means acting on the image bearing member are the array 2, the charger 4, the developing device 5, the image transfer discharger 8, the separating means 9*a*, the cleaner 13, etc. These process means may individually be mounted in or dismounted from the unit. Also, the unit may be mounted or dismounted from above or from below.

As described above, according to the present invention, the occurrence of the inclination of toner can be reduced during the transportation or custody of the process unit.

What we claim is:

1. A process unit having means for forming an image and removably mountable on an image forming apparatus body, the process unit comprising:

an image bearing member;

developer storing means for storing developer;

supporting means for supporting said image bearing member and said developer storing means on said body with respective longitudinal axes thereof extending horizontally; a handle means extending in the direction of said longitudinal axes provided at said supporting means and constructed and arranged relative to said process unit so that when said process unit is dismounted from said image formation apparatus body and transported by said handle means, said longitudinal axes are maintained substantially horizontal.

2. A process unit according to claim 1, wherein said developer storing means forms a part of developing means.

3. A process unit according to claim 2, wherein said process unit includes image bearing member cleaning means.

4. A process unit according to claim 2, wherein each of said developing means and cleaning means includes developer storing means.

5. A process unit according to claim 1, wherein said handle means serves as a guide when said unit is mounted on said apparatus body.

6. An image forming apparatus having a body and means for removably supporting on said body a process unit having means for forming an image, said apparatus comprising:

a process unit having an image bearing member, developer storing means for storing developer, supporting means for supporting said image bearing member and said developer storing means on said body with respective longitudinal axes thereof extending horizontally, and handle means extending in the direction of said longitudinal axes provided at said supporting means and constructed and arranged relative to said process unit so that when said process unit is dismounted from said image forming apparatus body and transported by said handle means said longitudinal axes are maintained substantially horizontal;

process means acting on the image bearing member of said process unit for forming an image; and guide means for guiding said process unit to a predetermined position of the apparatus body.

7. An image forming apparatus according to claim 6, wherein said handle portion of the process unit engages with said guide means of the unit to guide the unit to a predetermined position of the apparatus body.

8. An image forming apparatus according to claim 6, wherein said developer storing means forms a part of developing means.

9. An image forming apparatus according to claim 6, wherein said process unit includes image bearing cleaning means.

10. An image forming apparatus according to claim 6, wherein each of developing means and cleaning means includes developer storing means.

* * * * *

UNITED STATES PATENT AND TRADEMARK OFFICE

CERTIFICATE OF CORRECTION

PATENT NO. : 4,598,993

DATED : July 8, 1986

INVENTOR(S) : Mizutani et al.

It is certified that error appears in the above-identified patent and that said Letters Patent is hereby corrected as shown below:

Column 3, lines 38-9, change "and in parallel" to --and parallel--.

Column 3, line 41, change "20 in parallel" to --20 parallel--.

Column 4, line 20, change "lengthwisely" to --lengthwise--.

Column 4, line 51, change "made fur" to --made of fur--.

Column 4, line 58, change "No," to --No.--.

Column 5, line 34, change "horizontally; a" to --horizontally; and--.

Column 5, lines 35-6, change "handle means extending in the direction of said longitudinal axes provided at said supporting means and" to --handle means provided at said supporting means so as to extend in the direction of said respective axes and--.

Column 6, lines 19-21, change "extending in the direction of said longitudinal axes provided at said supporting means" to --provided at said supporting means so as to extend in the direction of said respective axes--.

UNITED STATES PATENT AND TRADEMARK OFFICE

CERTIFICATE OF CORRECTION

PATENT NO. : 4,598,993

DATED : July 8, 1986

INVENTOR(S) : Mizutani et al.

It is certified that error appears in the above-identified patent and that said Letters Patent is hereby corrected as shown below:

Column 6, line 32, change "portion" to --means--.

Signed and Sealed this

Fourth Day of November, 1986

[SEAL]

*Attest:*

DONALD J. QUIGG

*Attesting Officer*

*Commissioner of Patents and Trademarks*